United States Patent [19]

McCabe

[11] Patent Number: 4,910,923

[45] Date of Patent: Mar. 27, 1990

[54] SHARPENING TOOL

[76] Inventor: Edgar H. McCabe, 64 Bosworth Crescent, Kitchener, Ontario, Canada, N2E 1Z1

[21] Appl. No.: 323,062

[22] Filed: Mar. 13, 1989

Related U.S. Application Data

[63] Continuation of Ser. No. 102,628, Sep. 30, 1987, abandoned, which is a continuation-in-part of Ser. No. 43,483, Apr. 23, 1987, abandoned.

[51] Int. Cl.[4] ..... B24D 15/06

[52] U.S. Cl. ..... 51/205 WG; 51/212; 51/214; 76/82; 76/83

[58] Field of Search ..... 51/208, 205 WG, 211 R, 51/211 H, 204, 212, 214, 181 R; 76/82, 82.2, 83

[56] References Cited

U.S. PATENT DOCUMENTS

| | | | |
|---|---|---|---|
| 438,699 | 10/1890 | Merrill | 76/83 |
| 1,006,000 | 10/1911 | Oosdyke | 76/83 |
| 1,335,813 | 4/1920 | Berghman | 51/205 WG |
| 1,466,785 | 9/1923 | Brunell | 76/83 |
| 1,672,508 | 6/1928 | Vallery | 51/205 WG |
| 2,042,916 | 6/1936 | Viozzi | 51/205 WG |
| 2,054,495 | 9/1936 | Corkum | 51/205 WG |
| 2,092,831 | 9/1937 | Cannon | 51/205 WG |
| 2,327,717 | 8/1943 | Johnson | 76/83 |
| 2,443,733 | 6/1948 | Karge | 51/212 |
| 3,157,973 | 11/1964 | Chattillion | 51/205 WG |

FOREIGN PATENT DOCUMENTS

| | | | |
|---|---|---|---|
| 0683014 | 6/1930 | France | 51/205 WG |

*Primary Examiner*—Robert Rose

*Attorney, Agent, or Firm*—Anthony Asquith & Co.

[57] ABSTRACT

A tool for sharpening ice-skates is disclosed. The tool is hand-held, and uses a magnet to hold the cutting surface against the skate blade. The cutting face of the tool is convexly curved to fit the hollow portion of the blade. A liner, impregnated with abrasive dust, may be interposed between the magnet and the blade. The liner may be removed, and the magnet rubbed directly against the blade for final, fine sharpening. A cover for the magnet includes a safety guard and a gripping aid.

1 Claim, 4 Drawing Sheets

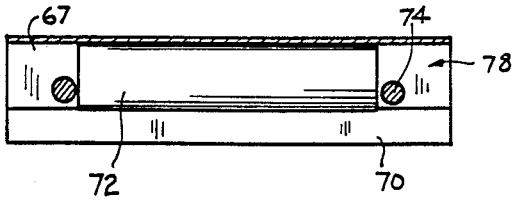
FIG 8
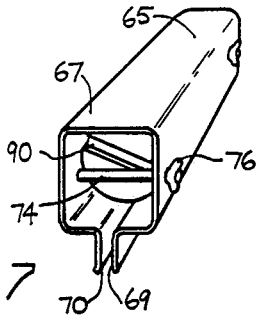
FIG 7
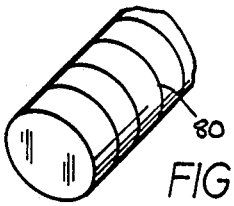
FIG 9
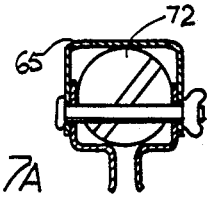
FIG 7A
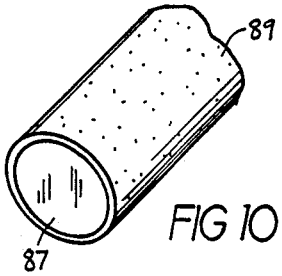
FIG 10
FIG 12
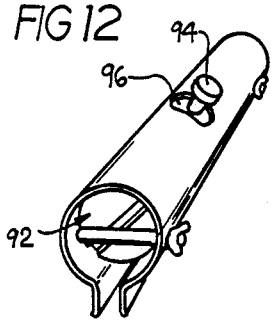
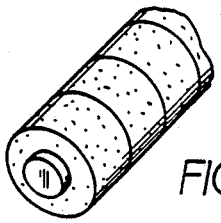
FIG 11

SHARPENING TOOL

CROSS REFERENCES TO RELATED APPLICATIONS

This is a continuation of application Ser. No. 102,628, filed Sept. 30, 1987 which is a continuation-in-part of application Ser. No. 043,483, filed Apr. 23, 1987 both abandoned.

This invention relates to a tool for sharpening steel blades. The tool of the invention is particularly useful in re-sharpening, or touching up, the blades of ice-skates.

BACKGROUND TO THE INVENTION

The task of keeping a good edge on skate blades is beset by a number of difficulties, which will now be described. Skate-blades have two knife edges, which run along the left and right sides of the blade. Usually, the region between the left and right knife edges is hollow, being ground to a concave curvature. Ice-skates are made in three main types: speed skates, figure skates, and hockey skates. The shape, length, and thickness of the blades of these types are somewhat different, but the left and right knife edges and the hollow grinding are a feature of most ice skates. Some types of speed skates are, however, sharpened flat, i.e. without the concavity between the knife edges, the reason being that some blades are so slim that hollow grinding would not be practical. If it were practical, however, hollow grinding would be preferred even with these very thin speed-skate blades.

It is important that the hollow grinding, if present, be maintained. Hollow grinding is important because a flat blade, when the blade was vertical during skating, would present a large surface area to the ice, and would skid if any lateral or sideways pushing against the blade were attempted.

It is also important that the two knife edges be straight and parallel, i.e. that both of the knife edges stand at the same height on the blade. Furthermore, there is little margin for error as regards the straightness and parallel-ness of the knife edges.

It is also important that, when the blade is being re-sharpened, the cutting motion takes place along the length of the blade. If the cutting or rubbing were to take place laterally with respect to the blade, the resulting cross-marks would give rise to a roughness, which would be quickly perceived by an expert skater.

Thus, if the skate blade is to be touched up by a rotating grinding wheel, it is necessary not only that the grinding machine include some means whereby the skate can be mounted most accurately, yet rigidly, relative to the grinding wheel; but it is also necessary that the wheel be set to rotate about an axis at right angles to the length of the blade; and it is also necessary that the wheel be kept accurately dressed to the correct curvature of the hollow region.

Such a grinding process as that just described requires, of course, a substantial apparatus—a fact which is no disadvantage as regards the task of sharpening the skate blade initially during manufacture of the skate, and the task of re-cutting the blade after the blade has suffered damage. But such a substantial apparatus is not really suited to the somewhat different task of touching-up a blade. Nevertheless, because of the absence of anything more appropriate, such grinding machines are in widespread use for touching-up.

There have been many proposals as to how the skate is to be located in the machine so that the knife edges are kept parallel, and so that only a minimum cut need be taken.

Following from the fact that the cutting force required to touch up the blade of a skate is quite small, it has been proposed, as an alternative to the grinding machine, to use a hand tool of the sharpening-stone type. The stone is held in the hand, and is rubbed to and fro along the length of the skate blade.

The problem with this and similar manual honing processes had been that the processes call for an extraordinary degree of skill on the part of the operator. It is all too easy for the operator to allow the stone to skew or wander sideways slightly, or to put more pressure on one knife edge than on the other. Besides the danger of spoiling the knife edges, operating a sharpening stone can be quite tiring to the muscles of the hand.

As mentioned, an expert skater is very sensitive to the slightest imperfections in the working surface of the blade. Accordingly, the touching-up of skate blades by the use of a hand-held stone is as a practical matter not available to the ordinary skater.

When skates have been reground on a grinding machine, it is possible to categorize three distinct states of the blade:

(1) just after re-grinding, the knife edges are too sharp, and the blades tend to dig into the ice rather too much, which can lead to strains and twists of the knees and ankles;

(2) once the knife-edges have settled down, the blade performs well;

(3) finally, the knife edges become dull and the blade starts to slip sideways when the skater pushes against the skate.

The second stage is quite short, so that the need arises for the skater to have the blades touched up at quite frequent intervals. But, if the skater uses the grinding machine method of touching up, he has to risk injury by going through the too-sharp first stage each time. Also, because the grinding machine has to take a sizeable cut each time it is used, the blade quickly becomes worn away.

Therefore, the general trend has been that a skater will wait until the knife edges become quite dull before having the blades touched up.

The invention is aimed at providing a sharpening tool in which the above problems and compromises are alleviated.

GENERAL DESCRIPTION OF THE INVENTION

In the invention, the sharpening tool is hand-held and hand-operated. The tool is provided with a means for preventing the tool from slipping askew across the blade; i.e. from rotating in the Yaw-sense relative to the blade. The tool is also provided with a means for preventing the tool from slipping in the Roll-sense.

In the invention, the means for preventing these two types of slippage of the tool are in operative engagement only with the blade itself, and do not, for instance, engage with the frame of a machine.

In the invention, it is recognized that the required degree of guiding and location from the blade itself, can be achieved either by magnetic attraction of the tool to the working surface of the blade, or through side cheeks which can be adjusted to engage the sides of the blade.

The magnetic version will be described first. Here, the tool is held against the working surface of the blade by virtue of the fact that the tool contains a magnet. In operation, the tool may be used with a liner interposed between the poles of the magnet and the working surface, and the liner is preferably impregnated with an abrasive dust. It is also contemplated in the invention that the steel of the magnet may be rubbed directly over the working surface. Even if a liner is used, it is preferred that the final rub be taken with the magnet touching steel-to-steel with the working surface.

The invention is not simply aimed at using a magnet to hold a cutting tool against any kind of sharpenable blade. It is recognized in the invention, that the use of a magnet to hold the tool against the blade is particularly applicable to the situation where:

(a) the blade has two, equally important, knife edges, which have to be maintained in strictly parallel relationship;

(b) the blade is of the kind in which the region between the two knife edges has to be concave or hollow;

(c) the tool has to move along (i.e. not across) the length of the blade to avoid cross-marks.

These are the factors which account for the difficulties of arranging a grinding machine for touching-up skate blades.

It may be that a skate blade is unique in that only in a skate blade are the above three factors present together. Insofar as the factors are present in other types of blade, however, the invention may be used to advantage with those blades.

Another aspect of the skate blade situation which makes the invention so applicable is that, in skate blades, the main need is not particularly for occasional major sharpening but rather for frequent touching up.

The tool of the invention produces knife edges that are not too sharp, especially when the operator finishes off with metal-to-metal rubbing.

It is recognized, in the invention, that the kind of steel which makes good permanent magnets is the kind of steel which when rubbed over the steel of a skate blade produces knife edges of ideal sharpness—sharp, but without the aggressive over-sharpness that is associated with just-ground edges.

With the tool of the invention, it is easy for a person with no particular skill of the hands to apply just the right amount of pressure to the tool during sharpening. In fact, if the magnet is selected properly, the operator need not apply any pressure at all in any direction other than to apply a force to move the magnet to and fro along the blade. It will be shown below how the operator can be aided in this purpose by suitable design of the tool.

In the tool of the invention, the operator can therefore devote all his hand control to keeping the tool square-on to the blade. It has been found that skaters find no difficulty at all in producing virtually perfect knife edges in only a minute or two, when using the tool of the invention.

In the magnetic version of the tool of the invention, the magnetic attraction should not be too weak, or the operator will have to apply pressure to hold the tool against the blade. As mentioned, it is when pressure has to be applied like that, that the operator starts to cause or allow the tool to become slightly misorientated, and the knife edges spoilt. Equally, the magnetic attraction should not be too strong, or it will become difficult for the operator to draw the tool along the blade with a smooth, controlled movement. It is recognized in the invention that the level of magnetic attraction inherent in an ordinary hand-held permanent horse-shoe magnet gives an ideal degree of pressure between the tool and the blade.

In the mechanical version of the tool of the invention, the tool includes a cover, which is provided with side cheeks. The side cheeks are arranged to engage either side of the skate blade, in such a way that the cover cannot roll laterally off the working surface of the blade, and in such a way that the cover cannot become skewed in the Yaw-sense with respect to the working surface.

Since skate blades differ somewhat as to their thicknesses, and since it is important that there be substantially no slack or free play between the cover and the blade, the cover is so made that the separation of the cheeks may be changed. It would not be sufficient, however, if the cheeks were simply flexible, and were held against the sides of the blade by manually squeezing the cheeks together: far more guide-control of the cover is required than could be achieved in this manner. The separation of the cheeks should be adjustable, preferably by means of a setting screw, with the result that the separation, once set, will remain constant.

The importance of the various guiding aspects of the tool as set out in respect of the magnetic version apply also to the mechanical version.

The invention is aimed at making it easily possible for skate blades to be always maintained in a perfect condition, neither too sharp nor too dull. Not only will this make skating more pleasurable as a sport, by enabling the skater to use the desired extent of his strength and skill without feeling any need to hold back to prevent slipping, but it will also make the sport safer.

The invention is also aimed at making it possible for a skater to maintain a hollow ground surface inexpensively and reliably, even on a very thin blade. Therefore, the invention may be regarded as opening up the possibility for speed skates to be hollow ground.

DETAILED DESCRIPTION OF PREFERRED EMBODIMENTS

In order that the invention may be further illustrated, descriptions now follow of examples of sharpening tools which embody the invention.

In the accompanying drawings:

FIG. 7 is a view of a fourth tool;

FIG. *7a* is a view of a fifth tool;

FIG. 8 is a longitudinal cross-sectional view of the tool of FIG. 7;

FIGS. 9–11 are views of alternative cutters that may be used in the tool of FIG. 7;

FIG. 12 is a view of a sixth tool.

Figure 1:
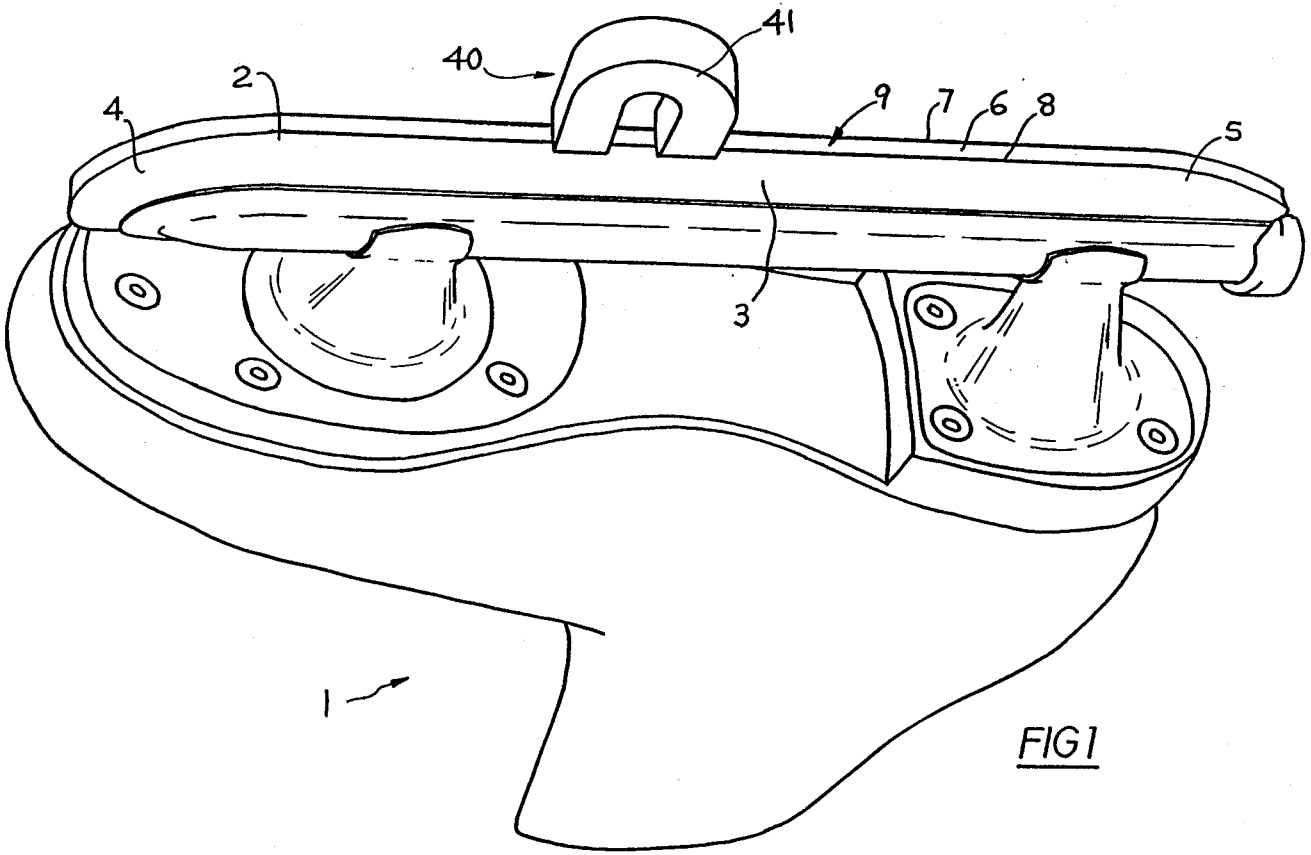
FIG. 1 is a view of a component of a first sharpening tool, in use on a skate blade.

The skate 1 shown in FIG. 1 has a traditional hockey-type blade 2, which is comparatively short, which has a straight center-portion 3 and which curves away smoothly at the end portions 4,5 of the blade 2. (The center portion 3 in fact is slightly curved, but is termed "straight " because the curvature is negligible when compared to that of the end portions 4,5.)

The blade 2 is hollow ground, having a concave region 6, which extends along the length of the blade 2, and which lies between a left knife edge 7 and a right knife edge 8. The knife edges 7,8 and the region 6 between them may be termed the working surface 9 of the blade 2.

Figure 2:
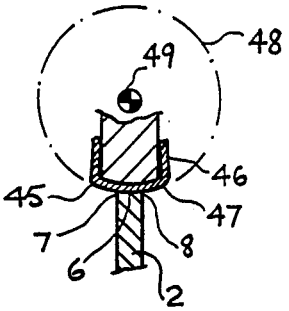
FIG. 2 is a cross-section of the tool of FIG. 1, in use on a skate blade.
Figure 3:
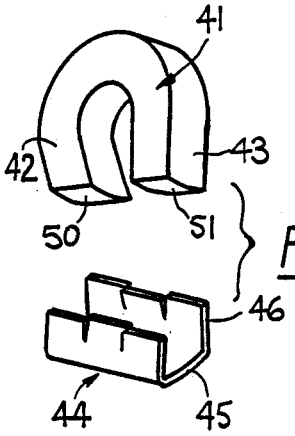
FIG. 3 is an exploded view of the components of the tool of FIG. 1.

The tool 40 shown in FIGS. 1, 2 and 3 includes a horshoe magnet 41 having two limbs 42,43 and a liner 44. The material from which the liner 44 is made is thin sheet steel, into which powdered abrasive material has been embedded or impregnated. Such material is readily available in a number of different abrasive grades and hardnesses.

The liner 44 is shaped as shown, with a curved portion 45, and two sides 46. The sides 46 are indented, so as to engage the gap between the limbs 42,43 of the magnet 41. The liner 44 is so arranged that the liner can be snapped on and off the magnet 41. When the liner is in place on the magnet, the bottom face 47 of the curved portion 45 of the liner is the cutting face of the tool 40.

The curvature of the portion 45 of the liner is set so as to correspond to the curvature of the concave region 6 of the working surface 9 of the blade 2. The different styles of ice skates have blades which differ as regards thickness and as regards the amount of hollowness (i.e. as regards the radius of the concave curve) which is required in the working surface 9. In many ice-skates, the concave curve has a radius in the order of 1 cm. The curve is uniform over the length of the blade, so that the curve forms part of a cylinder 48, which has a diameter in the order of 2 cm.

The axis 49 of the cylinder 48 is disposed parallel to, and symmetrically between, the knife edges 7,8 and it is important, during manufacture of the blade 2, and during touching-up, that the hollow or concave curve of the working surface be so formed that the axis 49 of the cylinder 48 is, as accurately as possible, a dead straight line, lying in the plane of the exact center of the thicknesses of the blade 2, over the length of the straight center-portion 3 of the blade.

The operator of the tool of the invention will generally carry out the touching-up process in two or more stages. The first stage involves the use of the liner 44, and different liners of progressively finer grade may be employed. In the last stage, the liner 44 is removed from the magnet, and the magnet is rubbed directly over the working surface 9 of the blade. This final steel-to-steel contact, probably because of a polishing or burnishing effect, has been found to produce an almost perfect quality of sharpness in the knife-edges, which it is not possible to achieve by grinding.

The operator generally finds it helpful to steady the skate between the knees during sharpening, or preferably against a bench or table. In the invention however, the purpose of this is simply that of holding the skate against something firm. This should be contrasted with the requirement, when the skate blade is to be touched-up in a grinding-machine, of mounting the skate in a jig, and of spending a good deal of time and skill setting and adjusting the jig so that the blade may be presented to the grinding-wheel in just the right manner. When using the tool of the invention, the cutting surface is presented to the blade correctly automatically, whereas when using a grinding-machine, correct presentation can only be achieved as a result of skill, care, and time. It is recognized that a tool in which the presentation of the cutting surface to the blade were to depend on the operator's skill, is not practical.

It may be noted that when the magnet 41 is being used without the liner, the end faces 50,51 of the limbs 42,43 become the cutting face of the tool. The two end faces are so formed as to comprise a unitary face which is set to the same cylindrical curvature as that of the bottom face 47 of the liner 44. There may be small errors or differences between the radius of curvature of the bottom face 47 and the radius of curvature of the end faces 50,51 of the limbs of the magnet, but it has been found that it is an easy matter to keep such errors small enough to be ignored.

If the skate is touched-up very frequently, and is not subjected to abuse, it is possible to keep the blade sharp solely by the use of the magnet alone, without the liner. The magnet on its own does not act primarily to remove metal from the blade, but acts rather to burnish and polish the knife edges to a fine state of sharpness.

Since the liner 44 acts to connect the two magnetic poles together, the liner will divert or draw off some of the magnetic forces. Therefore, it is important that the material of the liner be thin, so that the liner does not divert of absorb too much of the magnetic flux between the magnet and the blade.

Figure 6:
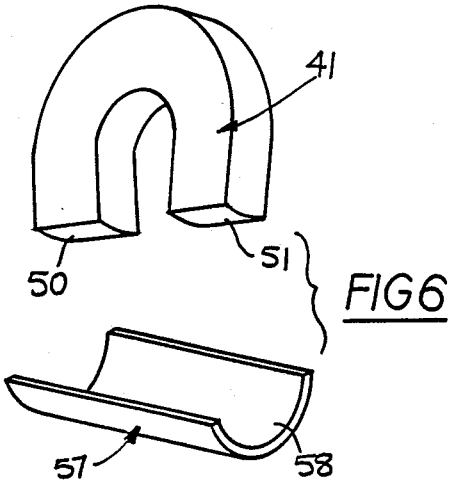
FIG. 6 is a view of a keeper, for use with the tool shown in FIG. 1.

The tool may include a keeper for the magnet, as shown in FIG. 6. The keeper 57 is made of a magnetic material and its main purpose is to prevent loss of magnetic strength during periods of non-use of the tool. The keeper 57 is curved, to conform to the concave curvature of the working surface of the blade. The fact that the keeper is curved means that the keeper can be used also to dress the cutting surface of the tool. The magnet end faces 50,51 can be rubbed over the inside face 58 of the keeper 57 from time to time, to keep the cutting surface dressed, and the bottom face 47 of the liner 44 can be kept dressed in a similar manner.

The inside surface 58 of the keeper 57 is about 10 cm long, and thus is considerably larger in area than the cutting surfaces 50,51 of the magnet, as may be seen in FIG. 6. This allows the operator to avoid a concentration of wear at one location of the surface 58, which in turn helps to maintain a uniform curvature to both the keeper and the tool over a long service life.

The surface 58 may be kept oiled, to lubricate the dressing process. A light cutting compound may be added to the oil if desired. Alternatively, the keeper can be kept dry: this allows the keeper then to be kept in the skater's pocket, and ready for use at any time.

The cutting face of the tool 40, with or without the liner 44, is wider than the thickness of the blade 2. Therefore, the tool may be misaligned slightly in the Roll-sense without the misalignment making any difference to the tool's effectiveness. As it happens, it is rather fortunate, for the purposes of the invention, that such Roll-misalignment does not produce errors, because the operator has no reference, at least by feel, as to when the tool is lying exactly in the plane of the blade. Of course, if the tool were to be so mishandled that it broke contact with one of the knife edges 7 and was only touching the blade along the other of the knife edges 8, that error would immediately be detectable: there would be a perceptible change in the feel of the tool due to the sudden reduction in magnetic attraction.

On the other hand, the tool cannot be allowed, during operation, to become misaligned with respect to the blade in the Yaw-sense, since Yaw-misalignment would tend to throw the knife edges 7,8 out of parallel. However, it is recognized that the tool of the invention possesses an inherent resistance to Yaw-misalignment. This inherent tendency to self-alignment in the Yaw-sense may be explained in that the cutting face of the tool tends to nestle into the hollow region 6 of the working surface 9 of the blade 2 and is held in that position by the magnetic forces. It is recognized that even the slightest skewing of the tool across the blade would be immediately detected by the operator because of the resulting sudden change in the magnetic attraction.

Apart from the fact that Yaw-misalignment would be immediately detected, it is recognized that Yaw-misalignment, or skewing, is in any event resisted by the magnetic forces—in order to become skewed, the tool would have to move away from the blade, i.e. against the magnetic attraction.

In the invention, the resistance of the tool to skewing is proportional to the axial length of the tool, which should therefore be substantial. It is recognized that the disposition of a horseshoe magnet in the manner illustrated gives an adequate axial length.

Figure 4:
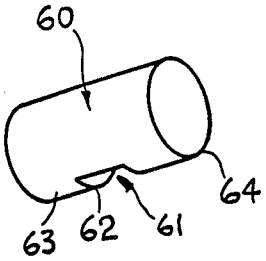
FIG. 4 is a view of a second tool.

FIG. 4 shows that the magnet in the tool of the invention may be made from a rod magnet 60, as opposed to a horseshoe magnet. The diameter of the rod 60 may be the 2 centimeter dimension as mentioned previously, or a curvature of that diameter may be ground onto the surface of the rod.

A further problem that should be mentioned when using a grinding machine for touching up is that, in touching-up blades of the hockey type it is difficult to set the grinding wheel up to follow the curves at the end of the blades. This is not too severe a problem however because the portions of the knife-edges 7,8 on the curved ends 4,5 fortunately do not lose their sharpness so quickly as the portions of the knife edges in the center-portion 3 of the blade, nor is sharpness at the ends so critical.

Using the tool of the invention, it is not at all difficult to control the tool to follow the curves at the ends of the blade, although some care is needed because, as the tool comes off the straight center portion 3, the magnetic force inevitably changes.

However, it is an easy matter using the tool of the invention to achieve a smooth, even, and gradual transition from the straight portion 3 of the blade 2 to the curved end portions 4,5 of the blade, even if the tool of the invention cannot accurately follow the working surface 9 right to the very tip of the blade. This may be contrasted to the use of the grinding machine for touching-up, where it is particularly difficult to obtain a smooth transition, especially when taking a light cut.

It is preferred that a gap 61, corresponding to the gap between the limbs of a horseshoe magnet, be incorporated into the rod magnet 60 shown in FIG. 4. The purpose of the gap may be explained as follows. When the magnet 60 is being used without a liner, a corner edge 62, formed by the gap 61 in the cutting face 63 of the magnet, acts to some extent as a cutting edge. The inner edge 62 therefore is important in achieving a good, smooth, transition between the straight portion 3 and the curved portions 4,5 of the blade.

A horseshoe magnet is however preferred to a rod magnet, in the invention, and another reason for that is that a horseshoe magnet has flat sides. A horseshoe magnet can therefore be pressed against the side faces of the blade 2, and can be rubbed along the side faces of the blade, to remove any slight burrs which might overhang the knife edges outside the thickness of the blade.

Figure 5:
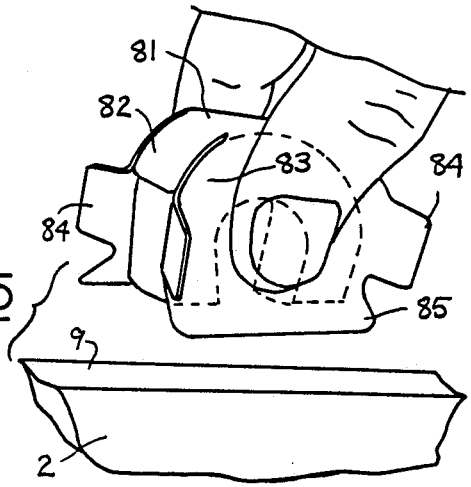
FIG. 5 is a view of a third tool.

In order to make the tool of the invention even more independent of the operator's lack of manual dexterity, the tool may be provided with a specially shaped cover 80, as illustrated in FIG. 5.

The cover 80 includes a roof 81 with bent-over end-flaps 82 and side cheeks 83. The side cheeks are provided with left and right, front and rear wings 84, which are bent out laterally from the side cheeks 83 of the cover. The cover 80 also includes two bent-out guards 85. The horse shoe magnet is positioned inside the cover.

The wings 84 are useful because they allow the operator of the tool to apply the force necessary to move the tool to and fro along the blade, without the operator having to exert any other force at all. The operator does not even have to squeeze the side cheeks 83 of the cover. Therefore, even if the operator approaches the task of touching up the blade with some casualness, it is still easy for him to take the care needed to avoid damaging the knife edges.

The cover 80 allows the operator to hold the tool very delicately, and the wings 84 and the guards 85 act to protect the fingers of the operator from touching the knife edges, if his hand should slip.

The cover and the liner 44 may be used together if desired. The liner preferably should be detachable, so that the magnet can be rubbed directly against the blade, and the cover also may be detachable from the magnet.

FIGS. 7 to 12 show further embodiments of the invention, in which the location of the tool to the blade is achieved by mechanical rather than by magnetic means.

The tool shown in FIG. 7 includes a cover 65. The cover is formed of sheet metal, which is folded into the shape as shown. The cover 65 includes a portion 67 in the shape of a square tube. The square tube shape is interrupted, in that the metal is bent away from the tube portion 67 to form left and right cheeks 69,70. The cover 65 may be formed from a single sheet, as shown in FIG. 7, or may be a composite of more than one sheet, as in FIG. *7a*.

The square tube portion 67 is so sized as to comprise the walls of a hollow chamber 78. Housed within the chamber is a cutter 72 of right cylindrical shape.

The cutter 72 may be magnetic, but preferably is not: a non-magnetic cutter allows the swarf to fall clear from the working surface, so that swarf does not become trapped between the cutter and the working surface.

Two screws 74 extend across the chamber 78. Wing-nuts 76 are fitted to the screws 74. The screws lie a little below the center-line of the cutter 72. When the screws are tightened, therefore, the walls of the chamber are drawn together, to grip the cutter, and also the separation of the two cheeks is reduced.

In use of the tool of FIG. 7 on the skate blade 2, the nuts 76 are adjusted until the cheeks come into engagement with the side faces 10,12 of the blade 2. The nuts should not be overtightened, or the cheeks will bind on the blade, thus preventing to and fro motion. On the other hand, the nuts 76 should not be undertightened, or the to and fro motion will not be guided properly, in that there will be some slack or play between the tool and the blade. It has been found that it is a simple matter for the operator to adjust the nuts 76 such that the tool slides freely, yet without slack or play.

The cheeks 69,70 thus form a guiding means, whereby the cutter 72 may be guided and constrained against spurious Roll and Yaw movements with respect to the working surface 9 of the blade 2. It may be noted that the cheeks are not resiliently pressed against the sides 10,12, as by a spring: rather, the cheeks are held quite rigidly against separation. It follows from the fact that the guide-means formed by the cheeks is rigid, that even a clumsy operator finds it virtually impossible to impart spurious Roll and Yaw movements to the cutter.

The screws 74 may be fine-adjusted as sharpening progresses, to maintain the zero-slack condition. If a skater has several skates, he would adjust the screws afresh to each individual skate.

It should be noted that the range of adjustment provided by the screws is quite limited. It would not be possible, for example, to provide sufficient range of adjustment, by means of the screws, for all skate-blade thicknesses. It is preferred that three sizes of the tool as described be available: a thin size for speed blades of around 2 mm thickness; a medium size for hockey blades of around 3 mm thickness; and a thick size for figure blades of around 4 mm thickness. The reason why the tool should not be used for widely differing thicknesses is that as the cheeks 69,70 are spread apart, the cheeks start to diverge, and thus to permit the tool to Roll on the blade. The purpose of the screws is to permit fine adjustment of the fit of the tool to an individual blade, not the gross adjustment to a different style of blade.

The cutter 72 may comprise a cylinder of hardened steel. It would be usual to use an abrasive cutting compound, of the desired grade, when the cutter is steel. The cutter may include circumferential grooves 80 (FIG. 9) to act as reservoirs for the cutting compound.

Alternatively, the cutter may, as shown in FIG. 10, comprise a former 87, around which is cemented a liner 89 of thin sheet material impregnated with abrasive dust, as in the liner 44.

Alternatively again, the cutter may comprise a cylinder of abrasive material, which is moulded in the manner of a grinding wheel (FIG. 11).

The cutter may comprise a single cylindrical length, or may be made up of several shorter lengths, as in FIG. 11.

The cutter 72 is provided with a means 90 whereby the cutter may be rotated within the chamber 78. The cutter should be turned frequently, to avoid wearing a flat spot on the cutter. The screws may be slackened, or removed, to permit the cutter to be turned.

The dimensions of the tool illustrated are important. The tool should be convenient to hold in the hand, and should be adequately located on, and guided on, the blade. The following dimensions have been found to be satisfactory:

Diameter of cutter: 2 cm
Length of cutter: 6 cm
Length of cover: 10 cm
Depth of engagement of cheeks to blade: 0.75 cm The diameter of the cutter should be set so as to correspond to the hollow-grinding diameter. For the thicker blades, this diameter may be 22 mm or so.

The screws 74 are positioned close to the ends of the cutter, so as to act as axial abutments, to locate the cutter against axial movement in the cover 65.

In the further embodiment shown in FIG. 12, the cutter location chamber 92 is itself cylindrical. The square chamber 78 of the FIG. 7 embodiment is preferred over the cylindrical chamber 92, because the square chamber will accommodate a wider variation in the diameter of the cutter, and in the thickness of the skate blade. The cutter should not be allowed to become unduly slack within the chamber, although it is not essential that the cutter be gripped tightly by the walls of the chamber. If, in the cylindrical-cover embodiment of FIG. 12, the cutter should become slack when the cheeks have been correctly adjusted to the thickness of the skate blade, shims may be inserted between the wall and the cutter. In FIG. 12, the means for turning the cutter relative to the cover is a screw 94, which protrudes through a slot 96.

The outside side faces of the location chamber, where they are contacted by the fingers, may be knurled, to improve the grip and feel of the tool of the invention.

I claim:

1. Sharpening tool, which is suitable for sharpening a steel blade, the blade being of the kind in which a working surface of the blade includes two parallel knife edges disposed along the length of the blade, and where the region of the working surface between the two knife-edges is hollow, wherein:

the tool includes a cylindrical cutter, having a cylindrical axis, and a cutting face is formed on the cutter;

the tool is so constructed as to its size and shape that the tool is suitable for hand operation, in that during operation of the tool the cutting-face may be moved by hand to and fro longitudinally along the length of the working surface of the blade;

the tool includes a cover;

the cover includes two opposed cheeks, which are arranged for guiding engagement with the respective opposite sides of the blade to be sharpened;

the cheeks are long enough and deep enough in their engagement with the sides of the blade as to prevent the tool from becoming misaligned with respect to the working surface in a Yaw-sense, and to prevent the tool from becoming misaligned with respect to the working surface in a Roll-sense, with respect to the said cylindrical axis;

the cover includes opposed walls which define a hollow cutter-location chamber;

the said chamber is of such dimensions as to house the cutter therewithin, and the walls are so arranged as to locate the cutter in position in the cover for cutting engagement with the working surface of the blade when the cheeks are in engagement with the sides of the blade;

the chamber walls are so arranged that the cutter is so located within the cover as to be substantially rigid and immovable with respect to the cover;

the tool includes two threaded fasteners, each comprising a respective nut and a screw having a head;

in respect of each threaded fastener, the threaded fastener comprises an adjustment means for adjusting the distance apart of the two cheeks, whereby the cheeks may be so set in relation to the sides of the blade that the cover may move freely to and fro along the blade, and may move substantially without slack; in respect of each threaded fastener, the nut and screw head comprise a respective abutment means for preventing the cheeks from separating more than the said adjusted distance apart;

the abutment means is firm and rigid, to the extent that further separation of the cheeks is resisted solidly, and without resilience;

the cheeks comprise extensions of the walls of the chamber;

in respect of each threaded fastener, the threaded fastener extends across the chamber between the opposed walls thereof;

in respect of each threaded fastener, the threaded fastener has a central thread-axis, which is positioned close enough to the said cheeks that the distance apart of the cheeks may be reduced by the act of tightening the threaded fastener;

in respect of each threaded fastener, the axis of the threaded fastener is closer, by a substantial margin, than is the cylindrical axis of the cutter, to the blade;

and the two threaded fasteners are axially spaced a little further apart than the length of the cutter, and are so placed as to act as end stops to prevent the cutter from moving axially within the chamber.

* * * * *